US008857503B2

(12) United States Patent
Magill et al.

(10) Patent No.: US 8,857,503 B2
(45) Date of Patent: Oct. 14, 2014

(54) CALIBRATED BYPASS STRUCTURE FOR HEAT EXCHANGER

(75) Inventors: Desmond Magill, Fergus (CA); Asad Max Kaspar, Fergus (CA); Mark S. Kozdras, Oakville (CA)

(73) Assignee: Dana Canada Corporation, Oakville, Ontario (CA)

( * ) Notice: Subject to any disclaimer, the term of this patent is extended or adjusted under 35 U.S.C. 154(b) by 1228 days.

(21) Appl. No.: 12/421,199

(22) Filed: Apr. 9, 2009

(65) Prior Publication Data

US 2009/0255650 A1 Oct. 15, 2009

Related U.S. Application Data

(60) Provisional application No. 61/043,888, filed on Apr. 10, 2008.

(51) Int. Cl.

| | |
|---|---|
| ***F28D 1/02*** | (2006.01) |
| ***F28F 27/02*** | (2006.01) |
| ***F28F 3/08*** | (2006.01) |
| ***F28D 1/03*** | (2006.01) |
| ***F28F 13/08*** | (2006.01) |
| *F01P 3/18* | (2006.01) |

(52) U.S. Cl.

CPC ..... *F28D 1/0333* (2013.01); *F28F 3/08* (2013.01); *F28F 2250/06* (2013.01); *F28F 27/02* (2013.01); *F28F 13/08* (2013.01); *F01P 3/18* (2013.01)

USPC ..... 165/153; 165/103; 165/167

(58) Field of Classification Search

USPC ..... 165/153, 159, 280, 283, 103, 167, 96, 165/109.1

See application file for complete search history.

(56) References Cited

U.S. PATENT DOCUMENTS

| | | | | |
|---|---|---|---|---|
| 1,690,501 | A * | 11/1928 | Potts | 165/283 |
| 1,988,659 | A * | 1/1935 | La Mont | 122/39 |
| 3,696,620 | A * | 10/1972 | Pace | 60/321 |
| 3,877,514 | A * | 4/1975 | Beck | 165/286 |
| 3,983,903 | A * | 10/1976 | Kuehn, Jr. | 138/40 |
| 4,443,188 | A | 4/1984 | Buhler | |
| 4,577,593 | A * | 3/1986 | Teigen | 122/235.15 |
| 4,670,103 | A * | 6/1987 | Holl | 165/109.1 |
| 4,991,643 | A * | 2/1991 | Price et al. | 165/283 |
| 5,575,329 | A | 11/1996 | So et al. | |
| 5,797,450 | A | 8/1998 | Kawabe et al. | |
| 5,875,834 | A * | 3/1999 | Brooks | 165/11.1 |
| 5,906,237 | A | 5/1999 | Aikawa | |
| 5,950,715 | A * | 9/1999 | Jonsson et al. | 165/103 |
| 6,167,956 | B1 * | 1/2001 | Bostedo et al. | 165/284 |
| 6,220,340 | B1 * | 4/2001 | Cheong et al. | 165/103 |
| 2003/0121649 | A1 * | 7/2003 | Seiler et al. | 165/167 |
| 2004/0200604 | A1 * | 10/2004 | Fang et al. | 165/140 |
| 2005/0161203 | A1 | 7/2005 | Fang et al. | |
| 2006/0016584 | A1 * | 1/2006 | Sanatgar et al. | 165/152 |

* cited by examiner

*Primary Examiner* — Allen Flanigan
*Assistant Examiner* — Jason Thompson
(74) *Attorney, Agent, or Firm* — Marshall & Melhorn, LLC

(57) ABSTRACT

A by-pass conduit for a stacked plate heat exchanger is disclosed. The by-pass conduit is formed by first and second plate members that each have a substantially planar central portion surrounded by an offset peripheral flange, the peripheral flanges of the first and second plates being sealably joined together and the planar central portions of the first and second plates being in spaced opposition to define a bypass channel. A flow restricting structure provides a fluid restricting barrier in the bypass channel, the flow restricting structure defining a calibrated by-pass passage that regulates the flow of fluid through the bypass channel.

14 Claims, 8 Drawing Sheets

CALIBRATED BYPASS STRUCTURE FOR HEAT EXCHANGER

RELATED APPLICATION

This application claims priority to and the benefit of U.S. patent application Ser. No. 61/043,888 filed Apr. 10, 2008, the contents of which are incorporated herein by reference.

BACKGROUND

Example embodiments described herein relate to heat exchangers, and in particular, to heat exchangers with built-in bypass channels to provide some flow through the heat exchanger under a variety of operating conditions.

Where heat exchangers are used to cool oils, such as engine or transmission oils in automotive applications, the heat exchangers usually have to be connected into the flow circuit at all times, even where the ambient temperature is such that no oil cooling is required. Usually, the engine or transmission includes some type of pump to produce oil pressure for lubrication, and the pump or oil pressure produced thereby causes the oil to be circulated through the heat exchanger to be returned to a sump and the inlet of the pump. Under cold ambient conditions, the oil becomes very viscous, sometimes even like a gel, and under these conditions, the flow resistance through the heat exchanger is so great that little or no oil flows through the heat exchanger until the oil warms up. The result is that return flow to the transmission or engine is substantially reduced in cold conditions to the point where the transmission or engine can become starved of lubricating oil causing damage, or the oil inside the engine or transmission can become overheated before the heat exchanger becomes operational, in which case damage to the engine or transmission often ensues.

One way of overcoming these difficulties is to provide a pipe or tube that allows the flow to bypass the heat exchanger in cold flow conditions. Sometimes a bypass channel or conduit is incorporated right into the heat exchanger between the inlet and outlet of the heat exchanger. The bypass conduit has low flow resistance, even under cold ambient conditions, so that some bypass or short circuit flow can be established before any damage is done, as mentioned above. Usually these bypass channels are straight or plain tubes to minimize cold flow resistance therethrough, and while such bypass channels provide the necessary cold flow, they have a deleterious effect in that when the oil heats up and the viscosity drops, excessive flow passes through the bypass channels and the ability of the heat exchanger to dissipate heat is reduced. In order to compensate for this, the heat exchanger must be made much larger than would otherwise be the case. This is undesirable, because it increases costs, and often there is insufficient room available to fit a larger heat exchanger into an engine compartment or the like.

Accordingly, an improved bypass structure for a heat exchanger is desired.

SUMMARY

According to one example embodiment, there is provided a heat exchanger comprising a plurality of stacked tubular members defining flow passages therethrough, the tubular members each having raised peripheral end portions defining respective inlet and outlet openings, so that in the stacked tubular members, the respective inlet and outlet openings communicate to define inlet and outlet manifolds. A bypass conduit is attached to the stacked tubular members. The bypass conduit has opposite end portions and a tubular intermediate wall extending therebetween defining a flow channel. The opposite end portions of the bypass conduit defining respectively a first fluid opening and a second fluid opening respectively communicating with the inlet manifold and the outlet manifold, the flow channel having a first flow passage portion in direct communication with the fluid inlet and a second flow passage portion in direct communication with the fluid outlet. The first flow passage and second flow passage communicate with each other through a flow restricting calibrated bypass flow passage for a continuous flow of fluid bypassing the stacked tubular members.

According to another example embodiment is a by-pass conduit for a stacked plate heat exchanger, comprising: first and second plate members that each comprise a substantially planar central portion surrounded by an offset peripheral flange, the peripheral flanges of the first and second plates being sealably joined together and the planar central portions of the first and second plates being in spaced opposition to define a bypass channel, and a flow restricting structure providing a fluid restricting barrier in the bypass channel, the flow restricting structure defining a calibrated by-pass passage that regulates the flow of fluid through the by-pass channel.

According to another example embodiment is a method of assembling a stacked plate heat exchanger comprising: (a) providing a bypass conduit by forming first and second plate members by roll forming or stamping, the first and second plate members each comprising a substantially planar central portion surrounded by an offset peripheral flange, the first and second plates being roll formed or stamped such that when the peripheral flanges of the first and second plates are sealably joined together the planar central portions are in spaced opposition to form a flow channel and collectively with the peripheral flanges define a flow restricting calibrated bypass flow passage along a portion of the flow channel; providing a plurality of tubular plate pair members each defining flow passages therethrough, the tubular plate pair members each having raised peripheral end portions defining respective inlet and outlet openings; and arranging the bypass conduit and the tubular plate pair members such that the tubular plate pair members are stacked with the respective inlet and outlet openings communicating to define inlet and outlet manifolds, and the bypass conduit is attached to the stacked tubular plate pair members with opposite end portions defining respectively a first fluid opening and a second fluid opening respectively communicating with the inlet manifold and the outlet manifold with the flow channel of the bypass conduit having a first flow passage portion in direct communication with the fluid inlet and a second flow passage portion in direct communication with the fluid outlet, and the first flow passage and second flow passage communicate with each other through the flow restricting calibrated bypass flow passage to permit a continuous flow of fluid bypassing the stacked plate pair tubular members.

BRIEF DESCRIPTION OF THE DRAWINGS

Example embodiments of the invention will now be described, by way of example, with reference to the accompanying drawings, in which the same reference numbers are used throughout the drawings to show similar features and components.

DETAILED DESCRIPTION OF THE INVENTION

Figure 1:
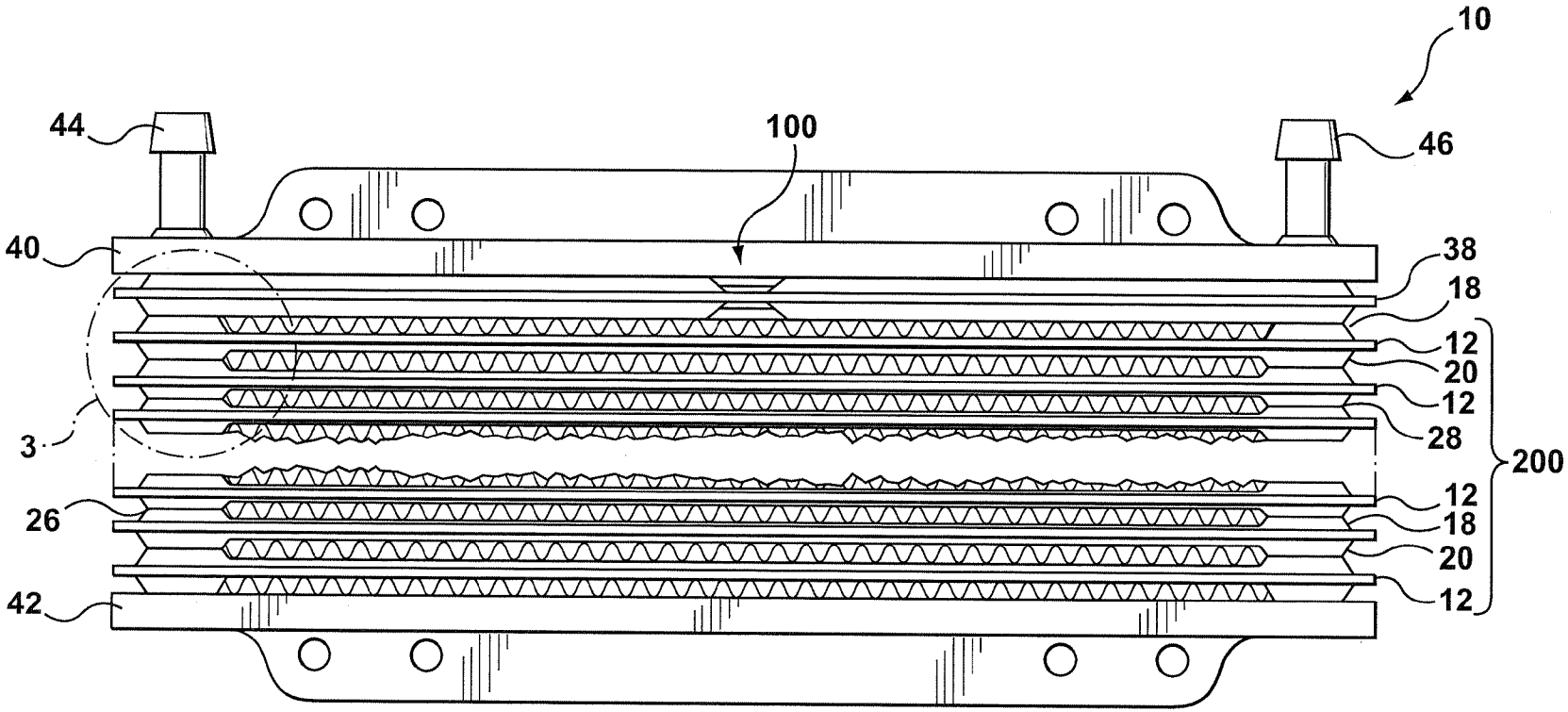
FIG. 1 is an elevational view of an example embodiment of a heat exchanger.
Figure 2:
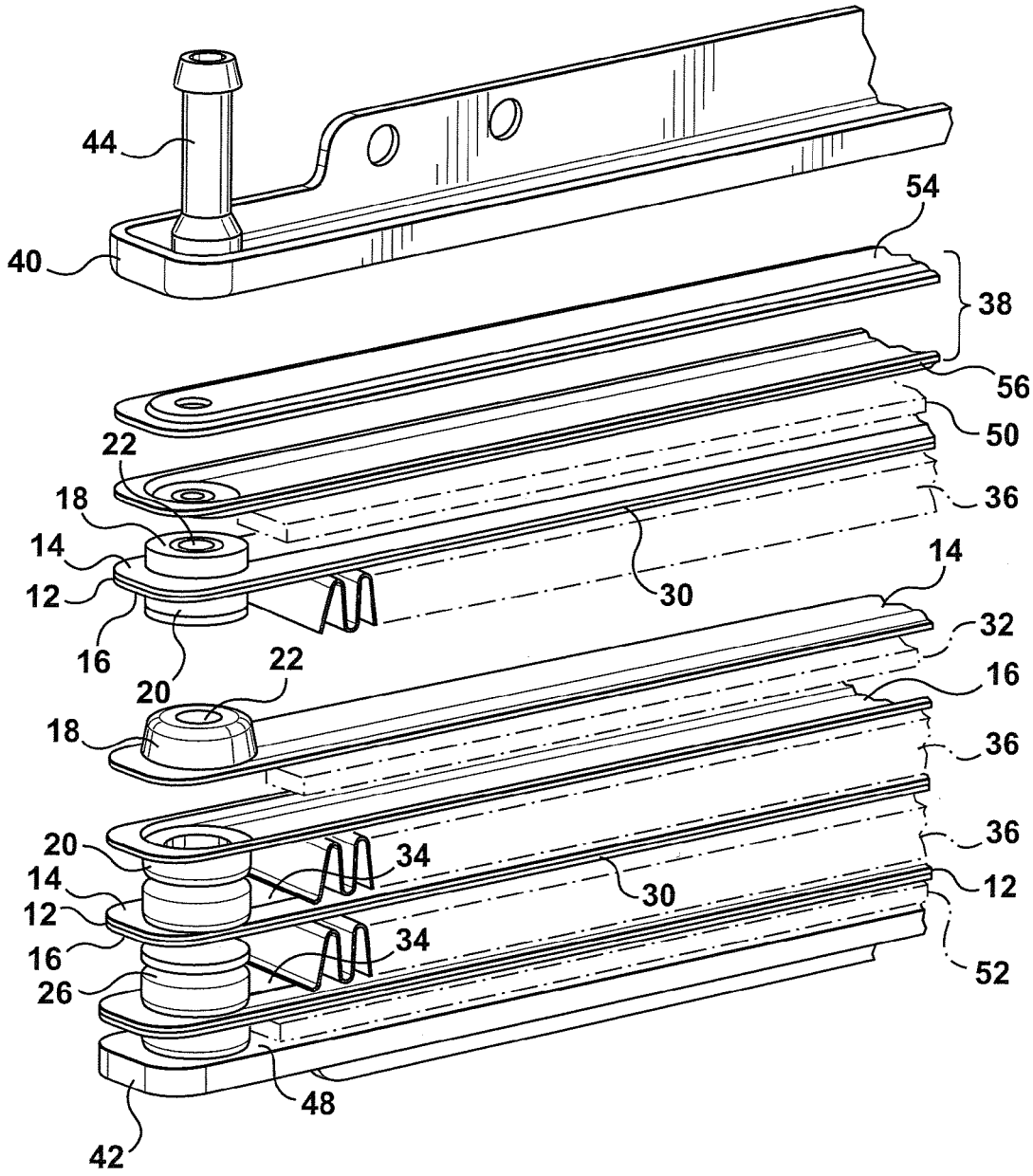
FIG. 2 is an enlarged, exploded, perspective view of the left side of the heat exchanger shown in FIG. 1.

Referring firstly to FIGS. 1 and 2, a heat exchanger according to example embodiments of the present invention is generally indicated by reference numeral 10. Heat exchanger 10 is formed of a plurality of stacked tubular members 12 defining flow passages therethrough. In the illustrated embodiment, tubular members 12 are formed of upper and lower plates 14, 16 and thus may be referred to as plate pairs. Plates 14, 16 have raised peripheral end portions 18, 20. End portions 18, 20 have respective inlet or outlet openings 22 (see FIG. 3), so that in the stacked tubular members 12, inlet/outlet openings 22 communicate to define inlet and outlet manifolds 26, 28. Tubular members 12 also have central tubular portions 30 extending between and in communication with inlet and outlet manifolds 26, 28. Inlet and outlet manifolds 26, 28 are interchangeable, so that either one could be the inlet, the other being the outlet. In any case, fluid flows from one of the manifolds 26 or 28 through the central portions 30 of tubular members 12 to the other of the manifolds 26, 28.

The central portions 30 of tubular members 12 may have turbulators or turbulizers 32 located therein. Turbulizers 32 are formed of expanded metal or other material to produce undulating flow passages to increase the heat transfer ability of tubular members 12. Turbulizers 32 and the internal dimensions of the plate central portions 30 cause tubular members 12 to have a predetermined internal cold flow resistance, which is the resistance to fluid flow through tubular members 12 when the fluid is cold. Heat exchanger 10 is typically used to cool engine or transmission oil, which is very viscous when it is cold. As the oil heats up, its viscosity drops and normal flow occurs through tubular members 12.

Figure 3:
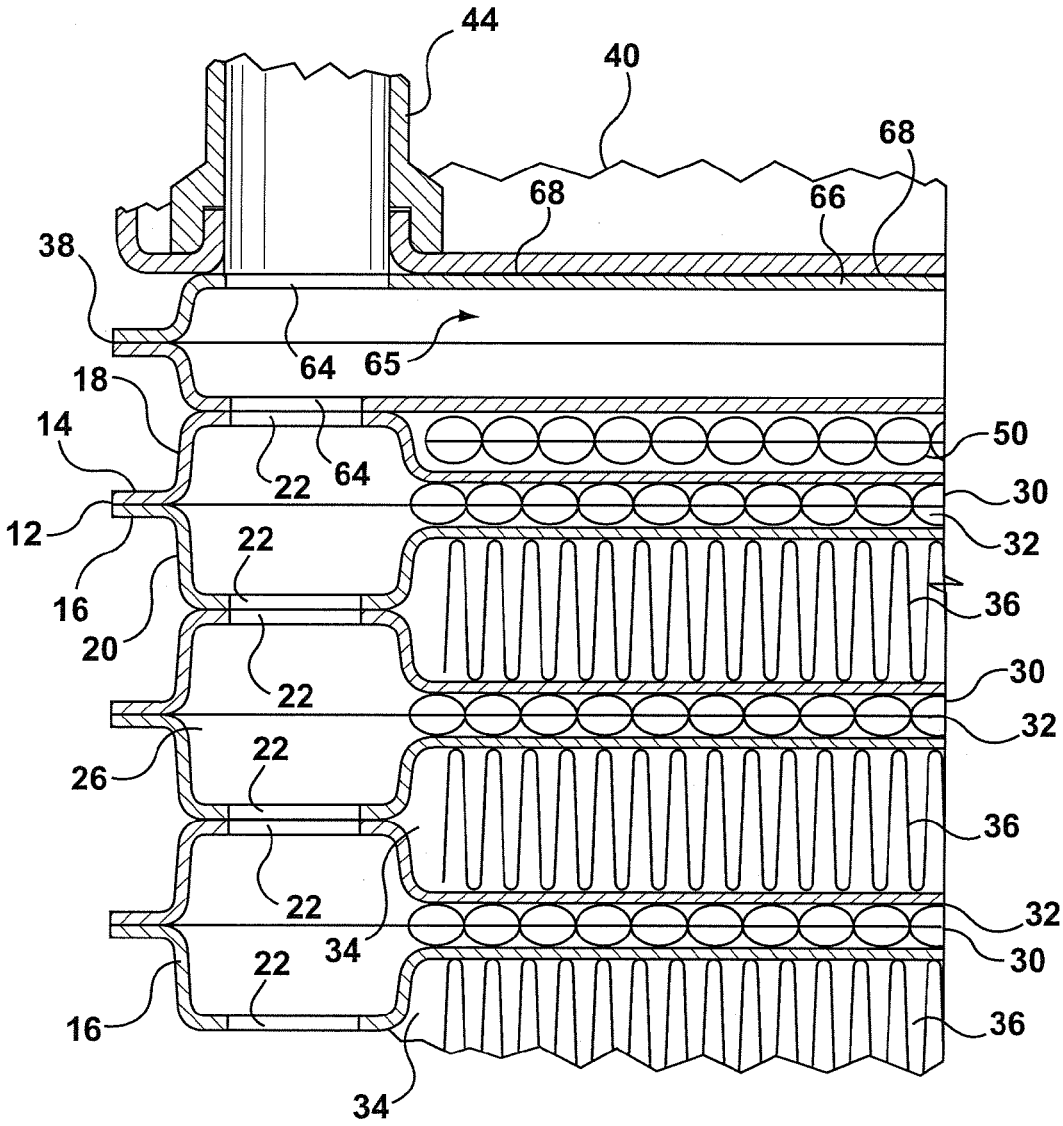
FIG. 3 is an enlarged vertical sectional view of the portion of FIG. 1 indicated by the chain-dotted circle 3.
Figure 4:
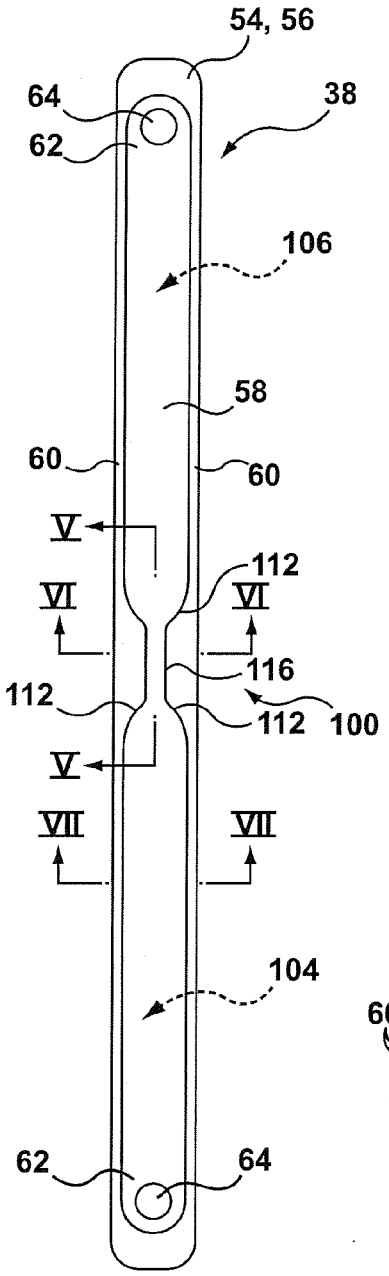
FIG. 4 is a plan view of the bypass channel of the heat exchanger of FIG. 1.

As seen best in FIGS. 2 and 3, the raised end portions 18, 20 of plates 14, 16 cause the central portions 30 of tubular members 12 to be spaced apart to define transverse external flow passages 34 between the tubular members. Corrugated cooling fins 36 are located in external flow passages 34. Normally air passes through cooling fins 36, so heat exchanger 10 may be referred to as an oil to air type heat exchanger.

Heat exchanger 10 also includes an elongate tubular bypass conduit 38, and top and bottom end plates or mounting plates 40, 42. Top mounting plate 40 includes inlet and outlet fittings or nipples 44, 46 for the flow of fluid into and out of inlet and outlet manifolds 26, 28. Bottom mounting plate 42 has a flat central planar portion 48 that closes off the inlet/outlet openings 22 in the bottom plate 16 of bottom tubular member 12.

As seen best in FIGS. 2 and 3, in an example embodiment a half-height cooling fin 50 is located between bypass conduit 38 and the top tubular member 12. Another half-height cooling fin 52 is located between the bottom tubular member 12 and bottom mounting plate 42. Half-height fins 50, 52 may be formed of the same material used to make turbulizers 32 to reduce the number of different components used to make heat exchanger 10. However, cooling fins 50, 52 can be made in other configurations as well, such as the same configuration as cooling fins 36, but of reduced height.

As mentioned above, tubular members 12 are formed of face-to-face plates 14, 16 and may thus be referred to as plate pairs. Plates 14, 16 are identical. Instead of using turbulizers 32 between the central portions 30 of these plate pairs 12, the central portions 30 could have inwardly disposed mating dimples to create the necessary flow turbulence inside the tubular members. Further, tubular members 12 do not need to be made from plate pairs. They could be made from tubes with appropriately expanded end portions to define manifolds 26, 28. Also, cooling fins 36, 50 and 52 could be eliminated if desired. In this case, outwardly disposed dimples could be formed in the tubular member central portions 30 to provide any necessary strengthening or turbulence for the transverse flow of air or other fluid between tubular members 12. It will be apparent also that other types of mounting plates 40, 42 can be used in heat exchanger 10. The stacked tubular members 12 may be referred to as a core 200. The core 200 can be any width or height desired, but usually, it is preferable to have the core size as small as possible to achieve a required heat transfer capability.

Referring next to FIGS. 4 to 9, an example embodiment of bypass conduit 38 will now be described in detail. In the embodiment of FIGS. 4 to 9, bypass conduit 38 is formed of two face-to-face, identical plates 54, 56, each having a central planar portion 58 and raised or offset peripheral flanges 60. Peripheral side walls 61 join central planar portion 58 to flanges 60. Bypass conduit 38, or at least plates 54, 56, have opposite end portions 62 that define inlet/outlet openings 64. Central portions 58 and peripheral side walls 61 form a tubular intermediate wall extending between opposite end portions 62 to define an internal bypass channel 65 extending between the respective inlet/outlet openings 64.

As seen best in FIG. 3, the inlet/outlet openings 64 of bypass conduit 38 communicate with the respective inlet and outlet manifolds 26, 28 and the inlet and outlet fittings 44, 46. So, for example, flow entering fitting 44 will pass into manifold 26 to pass through tubular members 12, but part of the flow will pass through the bypass channel 65 defined by the tubular intermediate wall 66.

Referring again to FIGS. 4-7, the central planar portions 58 of intermediate wall 66 are interrupted at a location between the inlet and outlet openings 64 to provide a flow restricting region 100 that defines a calibrated bypass passage 102 in the bypass channel 65. In particular, in the illustrated embodiment the intermediate wall 66 tapers inwardly at flow restricting region 100 to provide a smaller cross-sectional flow area than the remainder of the bypass channel 65. Thus, the bypass channel 65 has first and second flow passages 104 and 106 that communicate with each other solely through intermediate calibrated bypass passage 102. In an example embodiment, the cross-sectional flow areas of the first and second flow passages 104 and 106 are substantially equal, with the flow resistance of the calibrated bypass passage 102 being substantially greater than the rest of the bypass channel 65. Thus the bypass passage 102 defines the minimum cross sectional area of the bypass flow that flows along the length of bypass channel 65.

In an example embodiment, the plates that make up the bypass conduit 58 and tubular members 12 are formed of brazing clad aluminum. In order to provide a bypass passage 102 that is relatively tolerant to manufacturing and brazing variations that can occur when the plates 54, 56 are formed and then subsequently brazed together, a calibrated tubular structure 108, as shown in FIGS. 5, 6, 8 and 9 is secured between the plates 54, 58 in the flow restricting region 100 to define the calibrated bypass passage. In one example embodiment the calibrated tubular structure 108 is cylindrical with a length L, an inside diameter DI and an outside diameter DO. In at least some embodiments, the calibrated tubular structure 108 is secured in place in the flow restricting region 100 through brazing to the braze clad plates 54, 56, but is formed from non-braze clad steel or aluminum such that the inside diameter DI is substantially unaffected by the assembly and brazing process used to construct the flow conduit 58.

Figure 5:
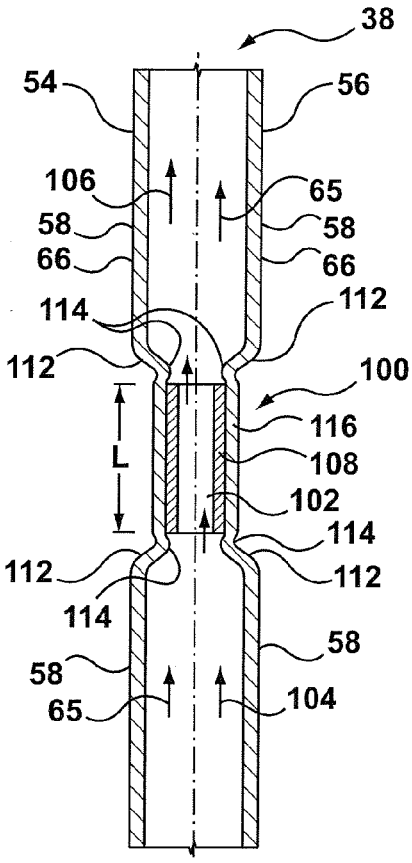
FIG. 5 is a partial vertical sectional view taken along lines V-V of FIG. 4.

The intermediate wall 66 provided by plates 54, 56 is shaped in the flow restricting region 100 to provide a seat 116 for the calibrated tubular structure 108. As shown in FIG. 5, the central planar plate portions 58 of plates 54, 56, each have portions 112 that taper inward both height-wise and width-wise in region 100 to reduce the size of the flow channel defined between plates 54, 56 to the outer diameter DO of the tubular structure 108, and thereby define the seat 116. Inward bumps or ridges 114 may be formed on the plates 54, 56 at opposite ends of the seat 116 to provide shoulders for positioning and retaining the tubular structure 108 in place during and subsequent to assembly of the fluid conduit 38. In at least one example embodiment, the inner ridges 114 are dimensioned to ensure that although they act against longitudinal movement of the tubular structure 108, they do not block any flow through the tubular structure 108.

Figure 6:
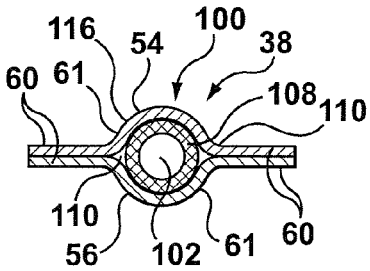
FIG. 6 is a vertical sectional view taken along lines VI-VI of FIG. 4.
Figure 8:
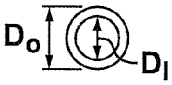
FIG. 8 is end view of a tubular member used to provide a calibrated bypass passage through the bypass channel of FIG. 4.
Figure 7:
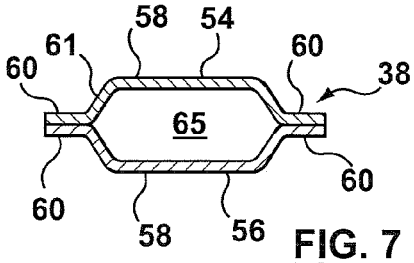
FIG. 7 is a vertical sectional view taken along lines VII-VII of FIG. 4.
Figure 9:
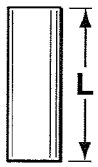
FIG. 9 is a plan view of the tubular member of FIG. 8.

As seen in FIG. 6, it will be appreciated that the walls of seat 116 defined by plates 54 and 56 may include areas 110 that are spaced apart from outer surface of the tubular structure 108. In at least some example embodiments, such areas 110 are filled with a fillet of braze material during the brazing process such that a fluid-tight seal is provided substantially around the entire outer surface of the tubular structure 108 and the only flow path between the first and second flow passages 104, 106 is through the interior of the calibrated tubular structure 108.

By using a tubular insert structure 108 to define the calibrated bypass passage 102 the length L and diameter DI of the bypass passage 102 can be tightly controlled, providing relative immunity against manufacturing variations in plates 54, 56 and the brazing process that might otherwise affect the predictability of the flow rate through the calibrated bypass passage 102. The tubular insert structure 108 and calibrated bypass passage 102 could have a non-circular cross-sectional shape—for example elliptical, rectangular or square shapes, among other things could be used. Furthermore, in at least some applications the tubular insert structure 108 may be omitted from the bypass flow conduit 38 such that the calibrated bypass passage 102 is defined soley by the inner surfaces of the plates 54, 56 at the flow restricting region 100; in such an embodiment, the bypass flow conduit 38 could for example be similar to what is shown FIG. 4-7, but without the tubular insert 108. In some example embodiments the plates 54, 56 are stamped or roll-formed to provide the configurations described herein.

In example embodiments, the relative dimensions of the calibrated bypass passage 102 to the remainder of the flow channel 65 through the bypass conduit 38 is such that the total amount of fluid flow through the entire bypass flow channel 65 is substantially determined by the dimensions of the calibrated bypass passage 102 rather than the dimensions of the remainder of the bypass flow channel 65. The length L and diameter DI of the calibrated passage bypass passage 102 are selected to allow a desired amount of fluid to bypass the main heat exchanger core area 200 during cold flow conditions without substantially reducing heat exchanger performance during normal operating or hot flow conditions. By way of non-limiting example, in some configurations the length L of the calibrated passage bypass passage 102 is substantially in the range of 5-8 mm and the diameter DI substantially in the range of 2-5 mm.

Some example considerations that go into determining the size of the length L and diameter DI of the calibrated bypass flow passage 102 in at least some example embodiments are as follows. It will be appreciated that the flow through the calibrated bypass flow passage 102 may reduce the heat transfer efficiency in the heat exchanger, because less fluid is going through the heat exchange passages. The calibrated bypass flow passage 102 is dimensioned so that this reduction in heat transfer does not exceed a predetermined limit under normal operating conditions. By way of non-limiting examples, in some applications of an engine oil cooler this predetermined limit is as low as 5% of the heat transfer rate of the heat exchanger without an orifice; in some applications of a transmission oil cooler, the predetermined limit is as low as 10% of the heat transfer rate of the heat exchanger without a bypass channel. In some applications, the predetermined limit could for example be as high as 25% of the heat transfer rate of the heat exchanger without a bypass channel. Alternatively, it may be possible to increase the efficiency of the heat exchanger or increase the size or number of the heat exchanger plates or tubes and fins used to make the heat exchange passages in order to make up for the reduction in heat transfer caused by the bypass flow.

The calibrated bypass flow passage 102 can also be dimensioned so as to reduce the fluid pressure drop in the heat exchanger by a predetermined minimum amount compared to the same heat exchanger with no bypass channel. This predetermined minimum amount may by way of example be between 10 and 30% under normal steady state heat exchanger operating conditions. In at least some engine oil applications, this predetermined minimum amount is could be about 10%, but it could be as high as 20% when the oil is hot. In the case of transmission oil or fluid applications, the predetermined minimum amount could for example be about 15%, but it could be as high as 30% under hot operating temperature conditions.

The calibrated bypass flow passage 102 can also be dimensioned so that if engine or transmission oil is the fluid passing through the heat exchanger, the flow rate of the oil through the heat exchanger is maintained above a predetermined lower limit at all operating temperatures, including cold start up conditions. By way of example, for some engine oil applications this predetermined lower limit could be about 8 liters (2 U.S. gallons) per minute. For some transmission fluid applications, the predetermined lower limit could be about 2 liters (0.5 U.S. gallons) per minute. By way of example, the calibrated bypass flow passage 102 can also be dimensioned so that the heat exchanger outlet pressure is at least 20 psi (3 kPa) approximately 30 seconds after the engine starts in the case of engine oil. By way of example, in the case of some transmission oil or fluid applications, the flow rate through the heat exchanger should be at least 2 liters per minute (0.5 U.S. gallons) per minute approximately 10 minutes from cold engine start.

Figure 10:
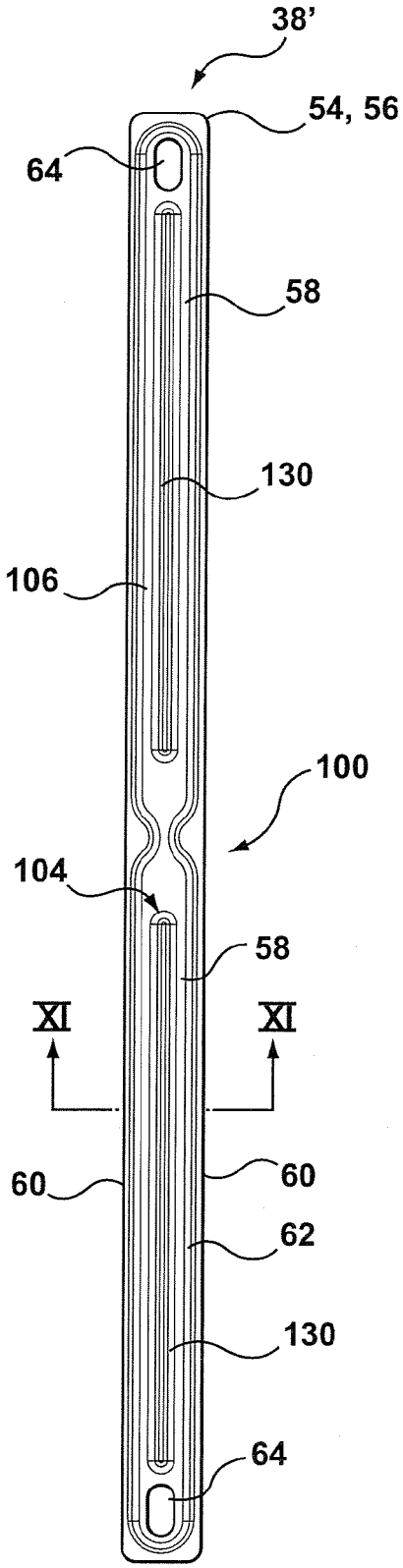
FIG. 10 is a plan view of a further embodiment of a bypass channel for a heat exchanger.
Figure 11:
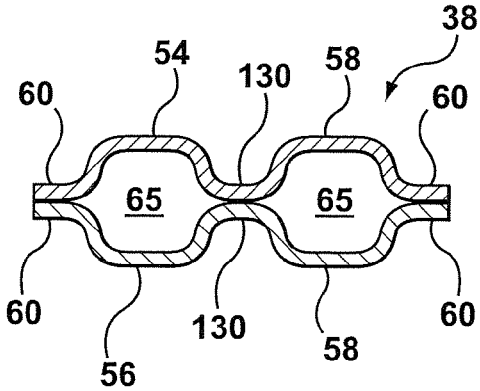
FIG. 11 is a vertical sectional view taken along lines XI-XI of FIG. 10.

In at least some example embodiments, inwardly directed ribs or dimples are formed on the central planar portions 58 of the plates 54, 56 of the bypass flow conduit to provide strength to the conduit. In this regard, FIGS. 10 and 11 show a further embodiment of a bypass conduit 38' which can be used in heat exchanger 10 is place of bypass conduit 38. The bypass conduit 38' is similar in construction and operation to conduit 38 except for the differences that will be apparent from the Figures and the following description. In conduit 38' each of the plates 54, 56 has elongate inwardly extending ribs 130 formed longitudinally along the central planar portion 58 thereof. Each of the ribs 130 extends from a location spaced apart from a respective inlet or outlet opening 64 to a location that is spaced apart from the restricted flow region 100. As shown in FIG. 11, the ribs 130 from the opposed plates 54, 56 mate, thereby dividing the bypass flow channel 65 longitudinally into two portions in the first flow passage 104 and the second flow passage 106.

Figure 12:
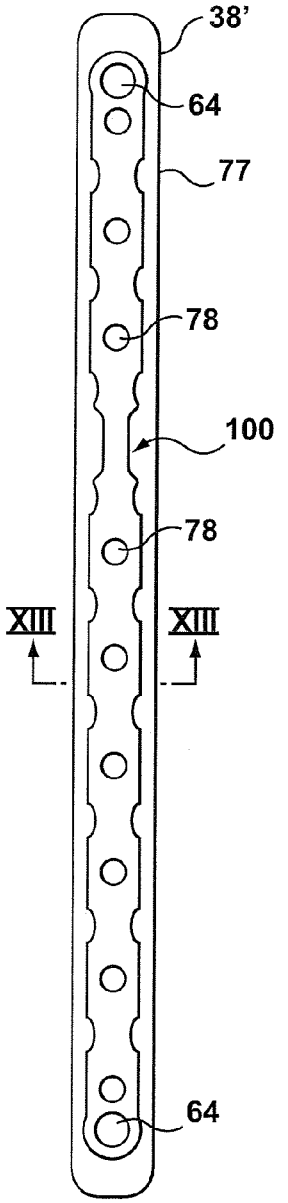
FIG. 12 is a plan view of a further embodiment of a bypass channel for a heat exchanger.
Figure 14:
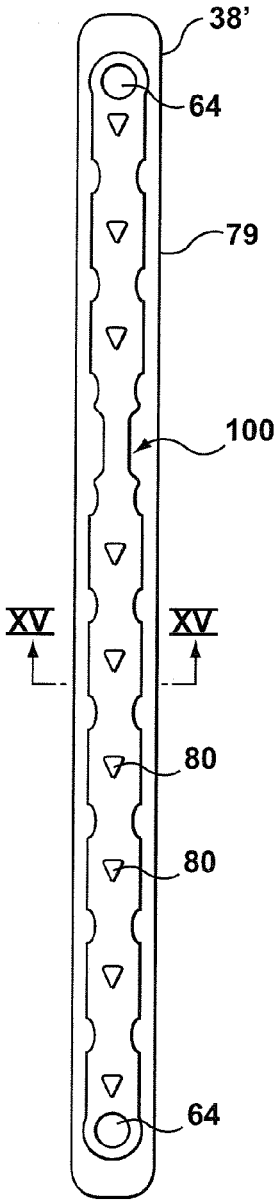
FIG. 14 is a plan view of a further embodiment of a bypass channel for a heat exchanger.
Figure 16:
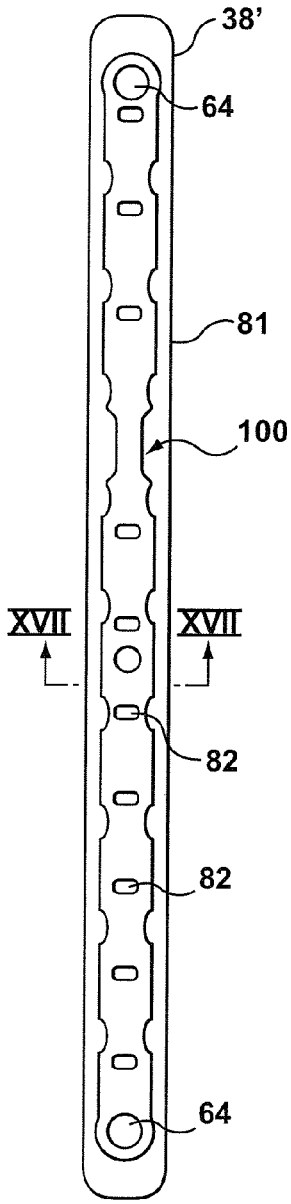
FIG. 16 is a plan view of a further embodiment of a bypass channel for a heat exchanger.
Figure 13:
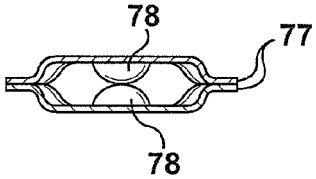
FIG. 13 is a vertical sectional view taken along lines XIII-XIII of FIG. 12.
Figure 15:
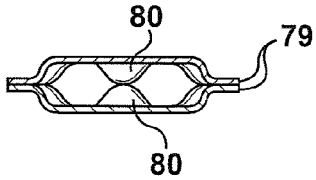
FIG. 15 is a vertical sectional view taken along lines XV-XV of FIG. 14.
Figure 17:
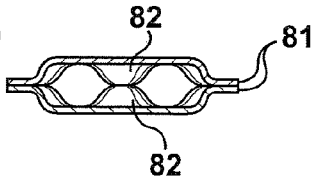
FIG. 17 is a vertical sectional view taken along lines XVII-XVII of FIG. 16.

Dimples can be used in bypass fluid conduit 38' instead of or in addition to ribs 130, as illustrated in FIGS. 12 to 17. FIGS. 12 and 13 show a bypass plate 77 having hemispherical dimples 78. Dimples 78 thus are circular in plan view. FIGS. 14 and 15 show a bypass plate 79 having pyramidal dimples 80 that are triangular in plan view. FIGS. 16 and 17 show a bypass plate 81 having rectangular dimples 82 having the long side of the rectangles in the transverse direction and the short side of the rectangles in the longitudinal direction, but dimples 82 could be orientated differently, such as on an angle, if desired. In fact, such elongate dimples 82 could be considered to be more like ribs than dimples. In the embodiment of FIGS. 12 to 17, it will be noted that the flow restricting region 100 of the conduits 38' can be located at an area other than the middle point between the inlet and outlet openings 64.

Figures 18, 19, 20, 21:
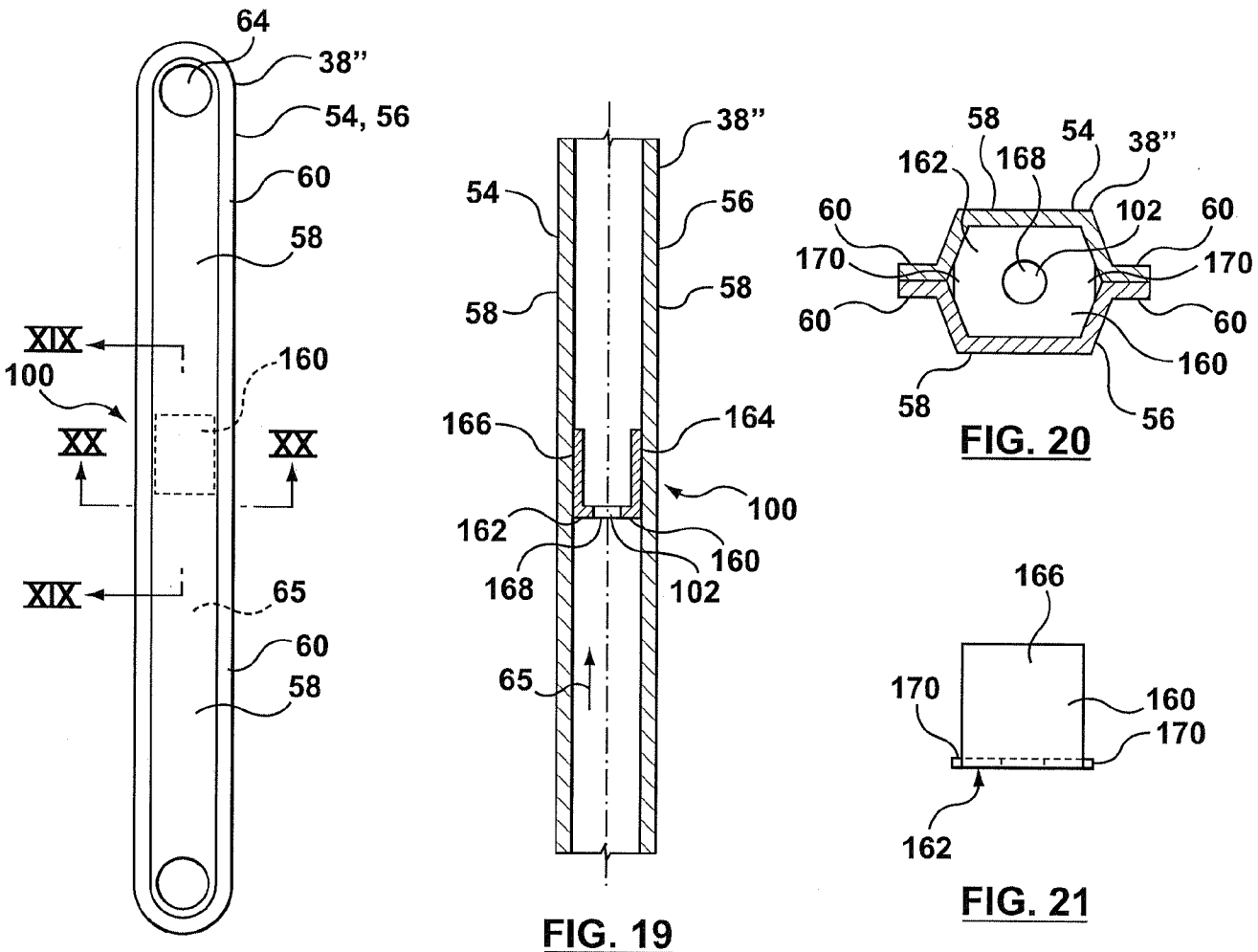
FIG. 18 is a plan view of a further embodiment of a bypass channel for a heat exchanger.
FIG. 19 is a partial vertical sectional view taken along lines XIX-XIX of FIG. 18.
FIG. 20 is a vertical sectional view taken along lines XX-XX of FIG. 18.
FIG. 21 is a plan view of a separator used to provide a calibrated bypass passage through the bypass channel of FIG. 18.

In at least some example embodiments, the calibrated bypass flow passage 102 can be defined by a structure other than a tubular insert 108 or a narrowing of the plates 54, 56 at the flow restricting regions 100. In this regard, FIGS. 19-20 illustrate a further embodiment of a bypass conduit 38" which can be used in heat exchanger 10 is place of bypass conduit 38 or 38'. The bypass conduit 38" is similar in construction and operation to conduits 38, 38" except for the differences that will be apparent from the Figures and the following description. In the bypass conduit 38", the planar central portions 58 do no taper inwards in the area of flow restricting region 100, but rather a U-shaped flow restricting plate insert 160 is located in the flow channel 65 at flow restricting region 100. The plate insert 160 includes central planar plate portion 162 from which spaced apart, opposed legs 164, 166 extend. Central plate portion 162 has a central opening 168 formed through it that functions as the calibrated bypass passage 102 for the bypass channel 65. In an example embodiment, the U-shaped flow restricting plate insert 160 is formed from non-braze clad aluminum or steel and is secured in place between the braze-clad plates 54, 56 through brazing of the legs 166, 164 to the plates 54, 56. As shown in FIGS. 20 and 21, the central planar plate portion can include side flanges 170 to conform to the interior walls of plates 54, 56. As the calibrated bypass passage 102 formed though the central plate 162 will have a shorter length than the length L of a tubular insert 108, the diameter of the calibrated bypass passage 102 would have to be smaller than that of a tubular insert 108 to achieve the same degree of flow restriction. Plate insert 160 could take many configurations other than what is shown. Additionally, the ribs or dimples shown in any of FIGS. 10-17 could also be used in the bypass conduit 38".

It will be appreciated that various modifications may be made to the structures described above. For example, in heat exchanger 10, the bypass conduit is shown at the top adjacent to top mounting plate 40. However, the bypass conduit could be located anywhere in the core or stack of plate pairs. Bypass conduit 38, 38', 38" has been described as being generally rectangular in cross section. However, it could have other configurations such as circular.

FIGS. 22-25 illustrate diagrammatically examples of different possible configurations for heat exchanger 10. The heat exchangers in FIGS. 22-25 are similar in construction and operation to the heat exchanger of FIG. 1, except that the locations of one or more of the bypass fluid conduit 38 (or fluid conduit 38' or 38" and the fluid inlet and outlet 44, 46 change from the structure that shown in FIG. 1.

Figure 22:
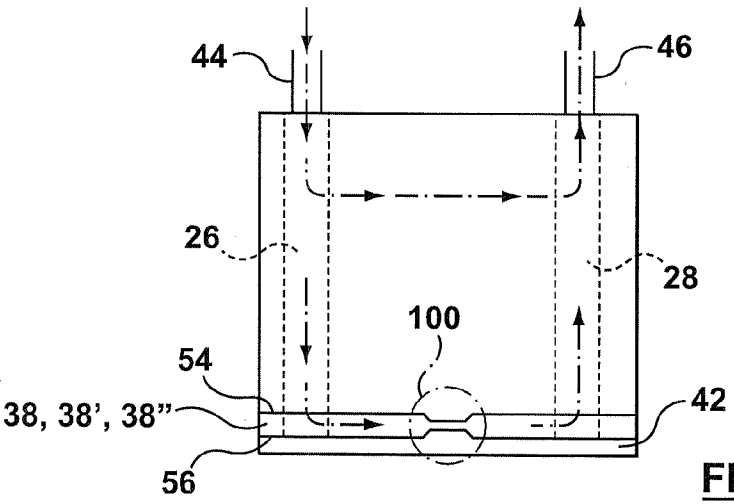
FIG. 22 is a diagrammatic view of another example embodiment of a heat exchanger incorporating a bypass channel.

In the embodiment of FIG. 22, the bypass fluid conduit 38 is located at the bottom end of the heat exchanger core 200 that is remote from the inlet and outlet fittings 44, 46, rather than at the same end with the inlet and outlet fittings 44, 46. The inlet and outlet openings 64 (see FIG. 4) in the top plate 54 of the bypass fluid conduit 38 respectively communicate with the inlet and out manifolds 26 and 28 of the heat exchanger core 12. The inlet and outlet openings 64 in the bottom plate 56 of the bypass fluid conduit 38 are sealed shut by bottom plate 42. In the embodiment of FIG. 22, fluid entering the inlet manifold 26 can bypass the heat exchanger core 200 and enter the outlet manifold 28 by passing through the by-pass conduit 38 in quantities regulated by the bypass flow restricting region 100.

Figure 23:
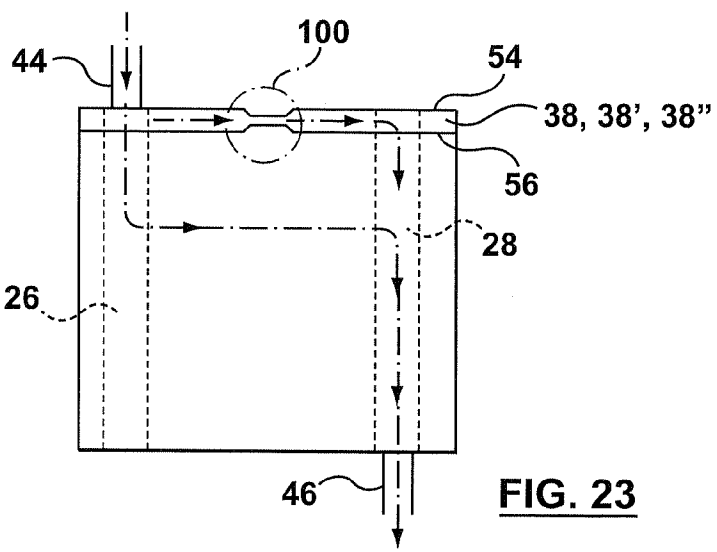
FIG. 23 is a diagrammatic view of another example embodiment of a heat exchanger incorporating a bypass channel.

In the embodiment of FIG. 23, the bypass fluid conduit 38 is located at the top end of the heat exchanger core 200, but the inlet and outlet fittings 44, 46 are located at opposite end corners. The inlet and outlet openings 64 in the bottom plate 56 of the bypass fluid conduit 38 respectively communicate with the inlet and out manifolds 26 and 28 of the heat exchanger core 12. The outlet opening 64 in the top plate 54 of the bypass fluid conduit 38 is absent or sealed shut. In the embodiment of FIG. 23, fluid entering the inlet fitting 44 can bypass the heat exchanger core 200 and enter the outlet manifold 28 by passing through the by-pass conduit 38 in quantities regulated by the bypass flow restricting region 100. The configuration of FIG. 23 could also be modified so the bypass conduit 38 is on the opposite end of the core 200 (i.e. the same end as the outlet fitting 46).

Figure 24:
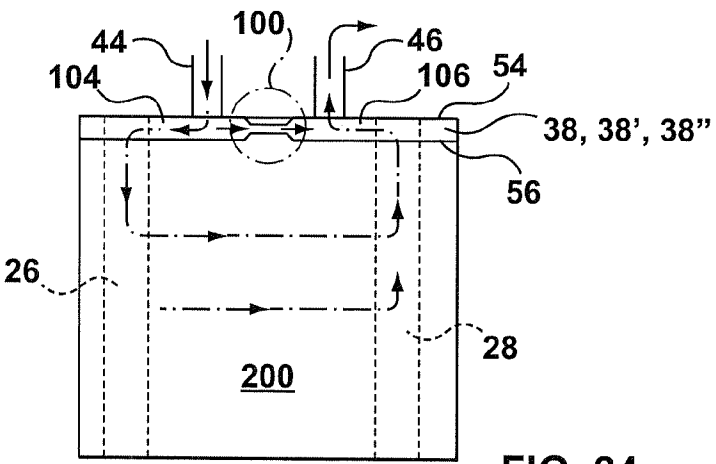
FIG. 24 is a diagrammatic view of another example embodiment of a heat exchanger incorporating a bypass channel.

In the embodiment of FIG. 24, the bypass fluid conduit 38 is located at the top end of the heat exchanger core 200, but the inlet and outlet fittings 44, 46 are located closer to the center of the heat exchanger such that the by-pass conduit 38 functions not only as a by-pass conduit but also as a cross over conduit. The inlet and outlet openings 64 in the bottom plate 56 of the bypass fluid conduit 38 respectively communicate with the inlet and out manifolds 26 and 28 of the heat exchanger core 12. The inlet and outlet openings 64 in the top plate 54 of the bypass fluid conduit 38 communicate respectively with the inlet and outlet fittings 44, 46, but are located closer together than the openings on the bottom plate 56. In the embodiment of FIG. 24, the primary hot flow path for fluid entering the inlet fitting 44 is through the first passage 104 of conduit 38 and into the inlet manifold 26, and then through heat exchanger core 200 and into the outlet manifold 28. From outlet manifold 28, the fluid flows into the second passage 106 defined by conduit 38 and then out through outlet fitting 46. This, the low flow resistance first and second passages 104 of the bypass conduit 38 in FIG. 24 function as primary hot-flow paths and in particular as a inlet crossover path and an outlet crossover path, respectively. A calibrated by-pass passage between the inlet (first) passage 104 and the outlet (second) passage 106 is provided through the bypass flow restricting region 100 that is located between the conduit 38 connections to inlet and outlet fittings 44, 46. In the embodiment of FIG. 24, fluid entering the inlet fitting 44 can bypass the heat exchanger core 200 (and conduit passages 105, 106) and enter the outlet fitting 46 by passing through the bypass flow restricting region 100.

Figure 25:
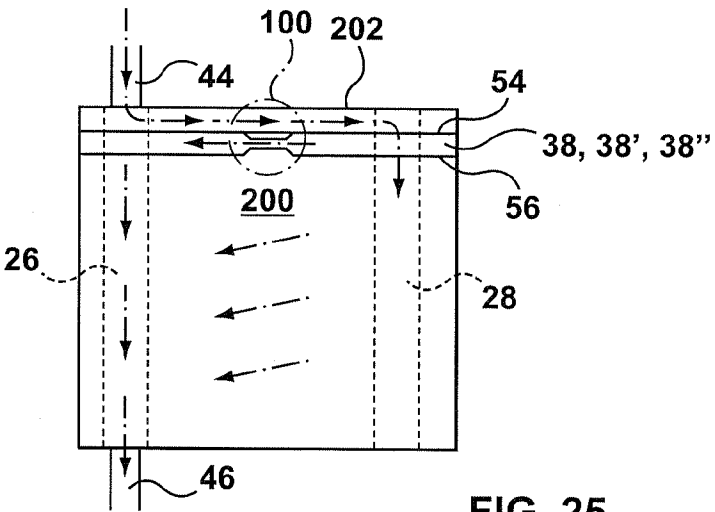
FIG. 25 is a diagrammatic view of another example embodiment of a heat exchanger incorporating a bypass channel.

In the embodiment of FIG. 25, the inlet and outlet fittings 44 and 46 are each located at the same side of the heat exchanger core 200. A crossover conduit 202 provides a flow path between the inlet fitting 44 and inlet manifold 26. The by-pass conduit 38 provides a calibrated by-pass path through restricting region 100 between inlet manifold 26 and outlet manifold 28. The crossover conduit 202 can alternatively be located at the opposite end of the core 200.

It will also be appreciated that the heat exchanger of the present invention can be used in applications other than automotive oil cooling. The heat exchanger of the present invention can be used in any application where some cold flow bypass flow is desired.

As will be apparent to those skilled in the art in the light of the foregoing disclosure, many alterations and modifications are possible in the practice of this invention without departing from the spirit or scope thereof.

The invention claimed is:

1. A heat exchanger comprising:

a plurality of stacked tubular members defining flow passages therethrough, the tubular members each having raised peripheral end portions defining respective inlet and outlet openings, so that in the stacked tubular members, the respective inlet and outlet openings communicate to define inlet and outlet manifolds; and a bypass conduit attached to the stacked tubular members and having opposite end portions and a tubular intermediate wall extending therebetween defining a flow channel having a longitudinal axis, the opposite end portions of the bypass conduit defining respectively a first fluid opening and a second fluid opening respectively communicating with the inlet manifold and the outlet manifold, the first fluid opening and the second fluid opening each having an axis generally perpendicular to the longitudinal axis of the flow channel defined by said tubular intermediate wall, the flow channel having a first flow passage in direct communication with the fluid inlet and a second flow passage in direct communication with the fluid outlet, wherein the first flow passage and second flow passage communicate with each other through a flow restricting calibrated bypass flow passage for a continuous flow of fluid bypassing the stacked tubular members, the flow restricting calibrated bypass flow passage being defined by a portion of the tubular intermediate wall that tapers inwardly width-wise and height-wise from the respective first and second flow passages forming a region of reduced cross-sectional area extending between and interconnecting said first and second flow passages, the flow restricting calibrated bypass flow passage having a length less than the length of either said first flow passage and said second flow passage, where the reduced cross-sectional area is defined by cross-sectional areas that are less than a cross sectional area of the first and second respective flow passages of the bypass conduit flow channel such that the flow restricting calibrated bypass flow passage has a flow resistance substantially greater than the flow resistance of the first flow passage and the second flow passage of the bypass conduit.

2. The heat exchanger of claim 1 wherein the flow restricting calibrated bypass flow passage further comprises an insert secured to the portion of the tubular intermediate wall of said bypass conduit forming the flow restricting calibrated bypass flow passage.

3. The heat exchanger of claim 2 wherein the insert is a tubular member.

4. The heat exchanger of claim 3 wherein the tubular intermediate wall defines a seat in which the tubular member is secured, the seat having inward ridges formed at opposite ends thereof to position the tubular member.

5. The heat exchanger of claim 4 wherein the bypass conduit comprises first and second plate members that each comprise a substantially planar central portion surrounded by an offset peripheral flange, the peripheral flanges of the first and second plates being sealably joined together and the planar central portions of the first and second plates being in spaced opposition to define the flow channel.

6. The heat exchanger of claim 1 wherein the bypass conduit comprises first and second plate members that each comprise a substantially planar central portion surrounded by an offset peripheral flange, the peripheral flanges of the first and second plates being sealably joined together and the planar central portions of the first and second plates being in spaced opposition to define the flow channel.

7. The heat exchanger of claim 6 wherein the planar central portions of the first and second plates narrow at a region of the flow channel to provide the flow restricting calibrated bypass flow passage.

8. The heat exchanger of claim 6 wherein the sealably joined peripheral flanges of the first and second plates are enlarged at the region of the flow channel where the flow restricting calibrated bypass flow passage is provided.

9. The heat exchanger of claim 6 wherein an elongate rib projecting inwardly into the flow channel from the planar central portion of the first plate engages an elongate rib projecting inwardly from the planar central portion of the second plate.

10. The heat exchanger of claim 6 wherein a plurality of inwardly projecting protrusions are provided on the planar central portions of the first and second plates, the protrusions from the first plate engaging respective protrusions from the second plate within the flow channel.

11. The heat exchanger of claim 6 wherein the first and second plates are roll formed or stamped plates and brazed together.

12. The heat exchanger of claim 1 wherein the heat exchanger includes an inlet fitting at a first end thereof in communication with the inlet manifold and an outlet fitting at the first end thereof in communication with the outlet manifold, the bypass conduit being located at the first end of the heat exchanger and having a conduit inlet communicating with the inlet fitting and a conduit outlet communicating with the outlet fitting.

13. The heat exchanger of claim 12 wherein the flow restricting calibrated bypass flow passage is located in the flow channel between the conduit inlet and the conduit outlet, and the conduit inlet is spaced apart from the first fluid opening such that fluid flows along a predetermined length of the flow channel from the conduit inlet to get to the inlet manifold and the conduit outlet is spaced apart from the second fluid opening such that fluid flows along a predetermined length of the flow channel from the outlet manifold to get to the conduit outlet.

14. The heat exchanger of claim 1 wherein the heat exchanger is a stacked plate heat exchanger with each of the tubular members being formed from a pair of elongate plates secured together about peripheral edges thereof.

* * * * *